US005117767A

United States Patent [19]

Sommer

[11] Patent Number: 5,117,767

[45] Date of Patent: Jun. 2, 1992

[54] DEVICE FOR COATING A WEB OF MATERIAL TRAVELING AROUND A BACKING ROLL

[75] Inventor: Herbert Sommer, Düesseldorf, Fed. Rep. of Germany

[73] Assignee: Jagenberg Aktiengesellschaft, Düsseldorf, Fed. Rep. of Germany

[21] Appl. No.: 517,006

[22] Filed: May 1, 1990

[30] Foreign Application Priority Data

May 22, 1989 [DE] Fed. Rep. of Germany ..... 3916620

[51] Int. Cl.[5] ..... B05C 1/08

[52] U.S. Cl. ..... 118/126; 118/249; 118/261; 118/410; 118/413

[58] Field of Search ..... 118/126, 249, 410, 413, 118/258, 261; 427/356

[56] References Cited

U.S. PATENT DOCUMENTS

| | | | |
|---|---|---|---|
| 3,245,377 | 4/1966 | Gettel | 118/249 |
| 4,738,877 | 4/1988 | Krautzberger | 118/410 |
| 4,808,445 | 2/1989 | Fujiwara et al. | 118/249 |
| 4,876,982 | 10/1989 | Claassen | 118/413 |
| 4,887,547 | 12/1989 | Sommer et al. | 118/410 |

FOREIGN PATENT DOCUMENTS

| | | | |
|---|---|---|---|
| 613796 | 1/1961 | Canada | 118/249 |
| 3623402 | 2/1988 | Fed. Rep. of Germany . | |
| 2178677 | 2/1987 | United Kingdom | 118/249 |

*Primary Examiner*—James C. Housel

*Attorney, Agent, or Firm*—Sprung Horn Kramer & Woods

[57] ABSTRACT

A device for coating a web of material, especially a web of paper or cardboard, that travels around a backing roll, with a coating roll that scoops liquid coating from a chamber and demarcates in conjunction with the backing roll a coating nip, and with a flow-control system including a final flow controller and an initial flow controller upstream thereof in the direction that the web travels in and demarcating in conjunction with the backing roll an initial flow-control nip. The device has a non-resiliently supported initial flow controller that extends into the vicinity of the coating nip and demarcates it in the form of a chamber at the outlet end, whereby the initial flow-control nip remains open to the backing roll and to an outflow channel to the coating roll.

9 Claims, 2 Drawing Sheets

DEVICE FOR COATING A WEB OF MATERIAL TRAVELING AROUND A BACKING ROLL

Figure 1:
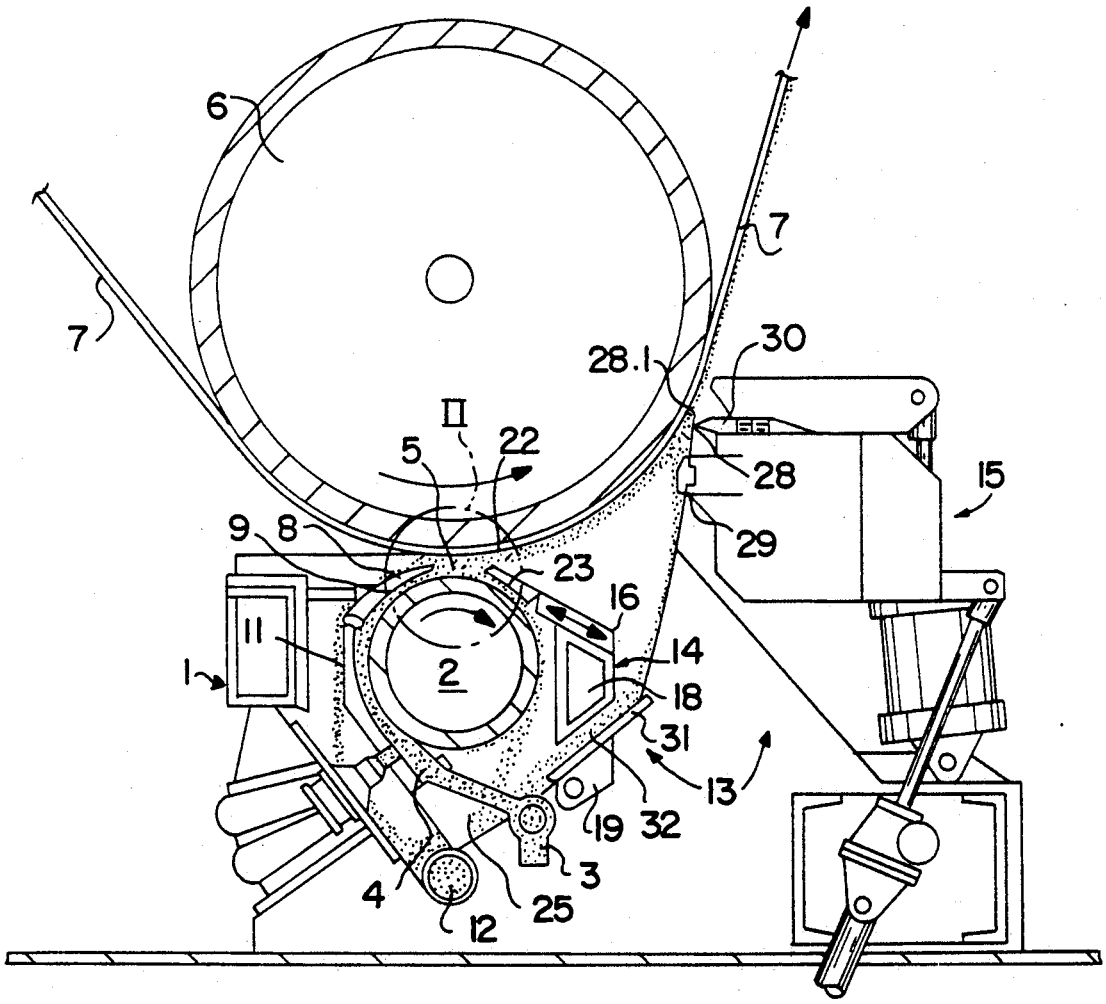

The invention concerns a device for coating a web of material, especially a web of paper or cardboard, traveling around a backing roll.

Devices for coating a web of material and containing a flooded-nip coater—a coater that scoops up liquid coating, which may be colored, and applies it to the material being coated in excess—followed by a two-stage flow-control system are known. Such a system comprises an initial flow controller, which removes most of the excess coating, and a final flow controller, which doctors it down to the desired thickness. The advantage of the initial flow controller is that just enough excess is entrained to wash the final flow controller, so that, once the irregularities have been smoothed out at that point, conditions will be uniform over the total width of the web downstream of the coating nip. It is important to adjust the initial flow controller to ensure partial dewatering of the thin surface layer of coating next to the web, wherein the solid constituents (pigments and binders) of the coating are most immobilized. The resulting layer accordingly acts as a barrier during the final flow-control process and prevents the solid constituents in the coating from penetrating into the web.

A generic device with this objective is described in German Pat. No. 3 623 402. A resiliently supported initial flow controller is positioned away from the coating nip, which is between the coating roll and the backing roll. Between the initial flow controller and the coating nip is a wedge-shaped coating channeler with openings upstream of the initial flow controller for the doctored-off coating to travel back to the coating roll trough.

It has, however, turned out to be a drawback in practice that initial flow controllers, which are hydrodynamic in principle and accordingly operate in direct opposition to the pressure of the liquid coating on the web (as described in German Pat. No. 3 623 402), are difficult to control. Since they are resiliently supported, they must be forced strongly against the liquid in order to function. It has been demonstrated that, even when this pressure is very slight, too much water is forced out of the coating, creating rheological problems during the final flow-control procedure that express themselves in the form of bleeding and/or streaks on the web. The desirable and positive effect of the dewatering accordingly becomes negative and undesirable.

The object of the invention is to provide a device that will provide better coverage even at high web speeds, with less coating being applied, and with less pressure against the final flow controller.

This object is attained by modifying a device for coating a web of material, such as a web of paper or cardboard, that travels around a backing roll, comprising a coating roll that scoops liquid coating from a chamber and demarcates in conjunction with a backing roll a coating nip, and a flow-control system comprising a final flow controller and an initial flow controller upstream thereof in the direction in which the web travels and demarcating in conjunction with the backing roll an initial flow-control nip. In accordance with the invention, the intial flow controller is non-resiliently supported, extends into the vicinity of the coating nip and demarcates it in the form of a chamber at the outlet end, whereby the initial flow-control nip remains open to the backing roll and to an outflow channel to the coating roll.

The invention achieves two advantageous results by way of a simple design. First, the non-resilient backing of the initial flow controller allows initial flow control with almost no pressure on the film of excess coating, eliminating the aforesaid drawbacks. Second, the chamber-like demarcation of the coating nip backs up the coating, allowing a wider nip. This decreases the penetration of the pressure in the nip, forcing less coating into the paper while leaving no irregularities (e.g. bubbles) in the coating when the web is traveling rapidly.

Supporting the initial flow controller against the coating roll ensures that the initial flow-control nip will be constant over the width of the web. Adjustability of the initial flow controller makes it possible to vary the initial flow-control nip independently of the coating nip. Having the surface of the initial flow controller at an obtuse angle to the tangent to the coating roll allows the effective liquid pressure to contribute to the uniformity with which the initial flow controller is supported on the coating roll, preventing hydrodynamic forces from lifting the controller from the roll.

Maintenance is facilitated by making the flow accommodation surface a replaceable blade and providing a replaceable wearing component, especially a wire, against the edge of the flow-accommodation surface of the initial flow controller adjacent to the backing roll.

Providing the initial flow controller with a main section having hollow spaces that act in the capacity of cooling channels prevents coating deposits. A baffle that extends into the coating nip and rests against the intake side of the coating roll makes the coating applied with the coating roll more uniform.

Figure 2:
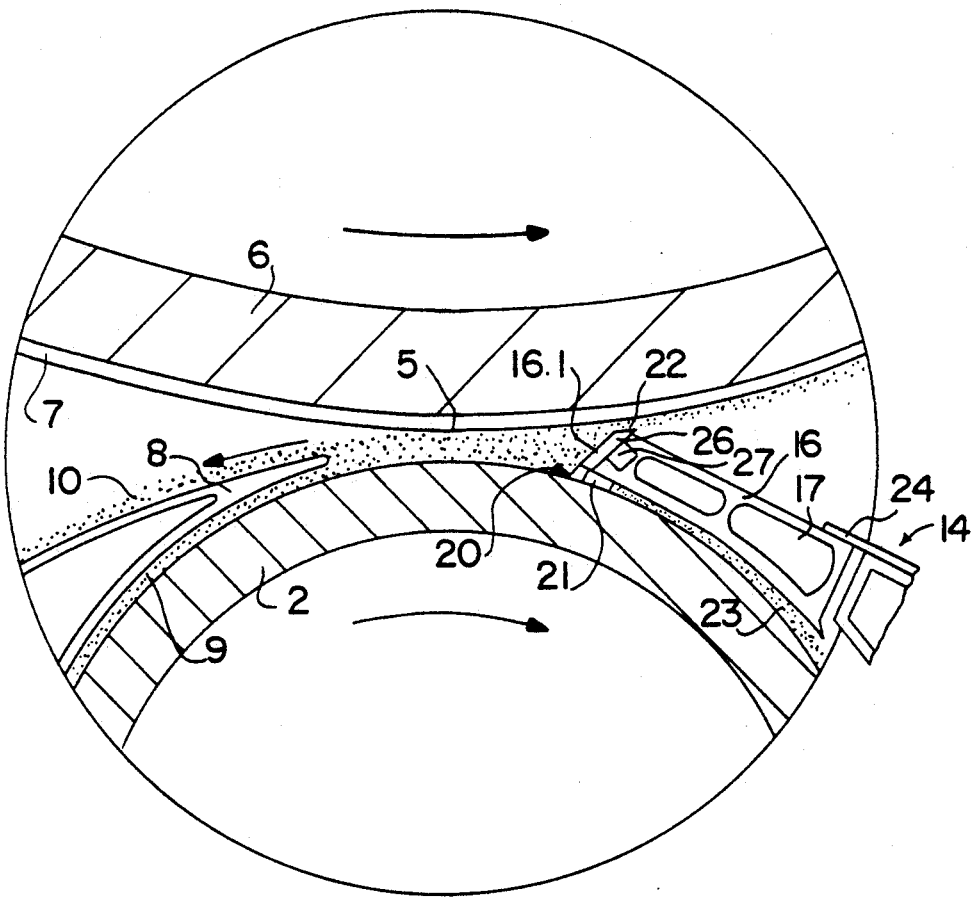

One embodiment of the invention will now be described with reference to the simplified drawings, wherein FIG. 1 is a side view of a coating device in accordance with the invention and FIG. 2 is a larger-scale section of FIG. 1 showing the initial flow controller.

A coating device has a coater 1 with a rotating coating roll 2 that in a known way forwards coating from a liquid-coating chamber 4, which communicates with an intake 3, into a coating nip 5 between the coating roll 2 and a backing roll 6, around which a web 7 travels. A baffle 8 at the intake end extends into coating nip 5. The surface of baffle 8 that faces coating roll 2 is curved to match the roll and positioned slightly off it, leaving a forwarding gap 9. The surface of baffle 8 that faces away from coating roll 2 constitutes a surface for recirculating excess material 10, which is supplied to a collecting line 12 by way of a recirculation line 11.

Downstream of and communicating with coater 1 is a flow-control system 13 comprising an initial flow controller 14 and a final flow controller 15. Initial flow controller 14 is illustrated in greater detail in FIG. 2 and has a main section 16 in the form of a thin length of box section (of aluminum coated with an anticorrosion material) extending over the width of the machine. The hollow spaces 17 inside section 16 act in the capacity of cooling channels, and a coolant flows through them. Section 16 extends more or less at a tangent to coating roll 2, and the end that faces away from backing roll 6 slides back and forth on a beam 18 mounted on a pivoting frame 19 more or less at a tangent to coating roll 2 and toward backing roll 6. The other end extends into the vicinity of coating nip 5, where it rests solidly and unresiliently on coating roll 2 on projections 21 that are perforated by outflow openings 20. The surfaces of projections 21 that rest against coating roll 2 have a low-friction coating or are provided with separate wear-resistant plates.

The surface 16.1 of section 16 facing backing roll 6 constitutes a flow-accommodation surface for the coating leaving coating nip 5, slopes at an obtuse angle to the tangent to the line along which section 16 rests against coating roll 2, and accordingly constitutes in conjunction with coating nip 5 an initial flow-control nip 22 that tapers together at an acute angle. The surface 16.1 of section 16 demarcates in the shape of a chamber the outlet side of coating nip 5, leaving only narrow initial flow-control nip 22, in conjunction with outflow channels 23, free along the surface of coating roll 2.

Initial flow-control nip 22 can be very precisely adjusted independently of the coating nip 5 between coating roll 2 and backing roll 6 by sliding section 16 along beam 18.

The surface of section 16 facing coating roll 2 curves to match the circumference of the roll, from which it is kept separate, however, by projections 21, creating the outflow channels 23, through which the superfluous coating can flow away. This prevents pressure from building up between coating roll 2 and section 16. Since section 16 is also prevented from lifting off coating roll 2 by the surface 16.1 that is at an obtuse angle to the tangent to the roll, the pressure of the liquid in initial flow-control nip 22 can force section 16 against coating roll 2. This situation also ensures that section 16 will rest uniformly against coating roll 2, creating an initial flow-control nip 22 that is constant over the operating width. Section 16 can alternatively rest directly against coating roll 2, in which case the side that rests against the roll will have outflow channels in the form of bores or slits. To ensure a secure contact between section 16 and coating roll 2, a resilient sheet 24 of metal is secured to the side facing away from the roll, forcing section 16 against coating roll 2. The excess coating flowing out through channel 23 is forwarded to collecting line 12 by way of a chamber 25.

The flow-accommodation surface of section 16 that demarcates initial flow-control nip 22 can be constituted directly by surface 16.1. In this case it is of advantage for the edge next to backing roll 6, which demarcates the narrowest point of initial flow-control nip 22, to be wear-resistant. A replaceable wire for example can be introduced at this point. The flow-accommodation surface in the embodiment illustrated in FIG. 2 is a short blade 26 secured in place by permanent magnets 27. The blade can be replaced when worn.

Next to initial flow controller 14, a conventionally designed final flow controller 15 is secured to a pivoting frame that is separate from beam 18. The final flow controller 15 in the present embodiment has a scraper 28 that is secured at the bottom in a clamping beam 29 and rests on a supporting beam 30. A final flow-control nip 28.1 is between the edge of the scraper and web 7 in operation. Other known flow-control mechanisms can be employed instead of scraper 28—a powered doctor rod or a scraper strip as described in German Pat. No. 3 338 323 for example. The excess coating scraped off during the final flow-control process is intercepted by a tub 31 and also supplied to collecting line 12 by way of an outflow channel 32. When the device in accordance with the invention is in operation, the width of coating nip 5 can to advantage be expanded between 1 and 3 mm even at high web speeds (1000–2000 m/min) with no air bubbles in the coating. The damming up of coating nip 5 as the result of the action of initial flow controller 14 will make the excess coating material uniform in conjunction with baffle 8, which separates the coating entering coating nip 5 from the returning excess.

The film of excess coating in coating nip 5 is then reduced to a substantially lower excess by initial flow controller 14 and doctored to the desired thickness by the final flow controller (scraper 28). It has turned out to be beneficial to the uniformity of the coating for the widths of nips 5, 22, and 28.1 to be more or less in the ratio 50:10:1.

The initial flow controller 14 in accordance with the invention exerts almost no pressure on the film of excess coating during the initial flow-control procedure because the controller does not operate in opposition to the pressure of the liquid but is non-resiliently and rigidly supported. The aforesaid problems that can occur during the final flow-control procedure as the result of excessive dewatering—bleeding and streaking for example—are eliminated. The cooling carried out by the cooling channels through hollow spaces 17 prevents the coating from depositing.

It will be understood that the specification and examples are illustrative but not limitative of the present invention and that other embodiments within the spirit and scope of the invention will suggest themselves to those skilled in the art.

What is claimed is:

1. In a device for coating a web of material comprising a backing roll around which the web travels, a coating roll that scoops liquid coating from a chamber and together with the backing roll demarcates a coating nip, and flow-control means downstream of the backing roll and comprising a final flow controller and an initial flow controller upstream thereof in the direction in which the web travels, the initial flow controller demarcating in conjunction with the backing roll an initial flow-control nip, the improvement wherein the initial flow controller is non-resiliently supported, rests against the coating roll, includes at least one outflow channel in communication with the coating nip and extending substantially in the direction of rotation of the coating roll, extends into the coating nip and forms a chamber at its outlet end, whereby the initial flow-control nip remains open to the backing roll and to the outflow channel to the coating roll.

2. A device according to claim 1, wherein the initial flow controller rests against the coating roll.

3. A device according to claim 1, including means for shifting the initial flow controller toward the backing roll.

4. A device according to claim 1, wherein the surface of the initial flow controller against which the liquid coating flows is at an obtuse angle to the tangent to the coating roll.

5. A device according to claim 4, wherein the initial flow controller includes a replaceable blade.

6. A device according to claim 5, wherein the initial flow controller adjacent to the backing roll has an accommodation surface with an edge, the device including a replaceable wearing component against such edge.

7. A device according to claim 1, wherein the initial flow controller includes a main section with hollow spaces that act as cooling channels.

8. A device according to claim 1, including a baffle that extends into the coating nip and rests against the intake side of the coating roll.

9. A device according to claim 1, wherein the ratio of the coating nip to the initial flow-control nip is approximately 50:10.

* * * * *